United States Patent [19]

Diamond

[11] Patent Number: 4,562,942

[45] Date of Patent: Jan. 7, 1986

[54] ROLLING DIAPHRAGM BARRIER FOR PRESSURIZED CONTAINER

[76] Inventor: George B. Diamond, Anthony & Woodglen Rds., Glen Gardner, N.J. 08826

[21] Appl. No.: 658,274

[22] Filed: Oct. 5, 1984

Related U.S. Application Data

[63] Continuation-in-part of Ser. No. 627,431, Jul. 3, 1984.

[51] Int. Cl.[4] ..... B67D 1/04

[52] U.S. Cl. ..... 222/386.5; 222/389

[58] Field of Search ..... 222/92, 94, 107, 130, 222/206, 212, 215, 386, 386.5, 389, 394, 402.1

[56] References Cited

U.S. PATENT DOCUMENTS

| | | | |
|---|---|---|---|
| 1,641,742 | 9/1927 | Dawson | 53/486 |
| 2,811,818 | 11/1957 | McCarty | 53/321 |
| 3,070,265 | 12/1962 | Everett | 222/389 X |
| 3,140,802 | 7/1964 | Everett | 222/386.5 |
| 3,233,779 | 2/1966 | Cornelius | 222/386.5 X |
| 3,273,762 | 9/1966 | O'Neill | 222/389 |
| 3,312,378 | 4/1967 | Featherstone et al. | 222/389 |
| 3,862,708 | 1/1975 | Waxlax | 222/444 |
| 3,923,208 | 12/1975 | Bergloff | 222/386 |
| 3,931,834 | 1/1976 | Caillet | 222/386.5 X |
| 4,109,833 | 8/1978 | Gross | 222/386.5 |
| 4,271,991 | 6/1981 | Diamond | 222/389 |

*Primary Examiner*—Joseph J. Rolla
*Assistant Examiner*—Michael S. Huppert
*Attorney, Agent, or Firm*—Ostrolenk, Faber, Gerb & Soffen

[57] ABSTRACT

A pressurized thin walled can from which a fluent pressurized product is dispensed through a discharge valve. The pressurized can is divided into a product chamber and a propellant chamber by an impervious flexible diaphragm, preferably shaped in the form of a cup and formed of a plastic material, which is mounted to the wall inside the can and away from the can ends. As product to be dispensed is introduced into the product chamber, the flexible diaphragm is extended down into the can. As the product is later expelled through a discharge valve, the flexible diaphragm is fully everted in the upper region of the can to expel all the product. The can is thin walled, and upon being pressurized, the can diameter expands slightly. In one embodiment, a ring inside the can holds the flexible diaphragm in place. The ring includes a portion which expands to maintain the seal with the expanding can side wall. In another embodiment the ring is rigid, but of slightly larger diameter than the can. This ring stretches the can, so as to maintain the sealing contact with the can as the can expands.

15 Claims, 9 Drawing Figures

FIG. 6
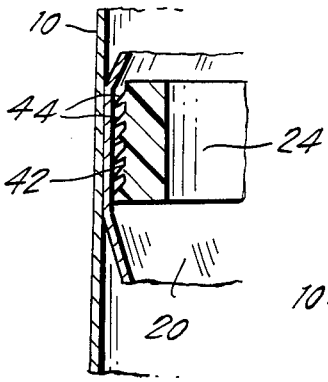
FIG. 8
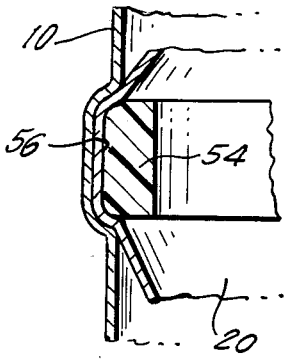
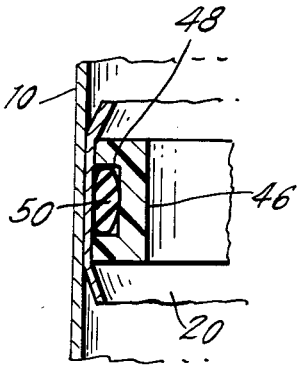
FIG. 7
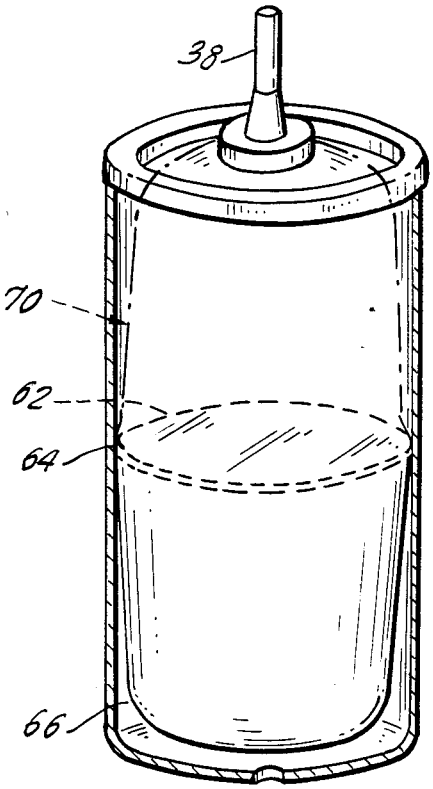
FIG. 9

ROLLING DIAPHRAGM BARRIER FOR PRESSURIZED CONTAINER

CROSS REFERENCE TO RELATED APPLICATION

This is a continuation-in-part of Application Ser. No. 627,431, filed July 3, 1984.

BACKGROUND OF THE INVENTION

This invention relates to pressurized cans from which a fluent product is dispensed by actuating a product discharge valve, and particularly, a pressurized can having a rolling diaphragm or barrier which separates the product from a pressurized gaseous or liquefied propellant.

Pressurized cans are used for dispensing liquid, semiviscous and viscous products. A can from which a liquid product is dispensed is often called an aerosol can. In some of these cans, in order to prevent cavitation, a barrier separates the product from the propellant. Three basic types of barriers in pressurized cans have typically been used, a piston system, a sprayed on strippable film bag, or a bag system.

In the piston system, a free piston, which is shiftable along the interior of the can, is the barrier. See U.S. Pat. No. 4,171,757. The piston system works for many products, but because the piston does not create an impenetrable barrier at the can wall, this system should not be used for products which may bypass the piston. Furthermore, the piston system is also ineffective with certain limited types of seamed cans, oddly shaped cans, cans that change in cross-section over the height of the can, and misshapen cans, since the barrier piston then has difficulty sealing to the wall of the can as the piston moves. The piston also may not seal correctly in soft or flexible walled or deformed cans.

In the strippable film system, a plastic composition is sprayed onto the peripheral side wall and the bottom wall of the can. As the product is expelled from the can, the film is pushed up by the pressurized propellant beneath it, and the film gradually strips away from the sides and bottom of the can to push the product out. Because the bag is being stripped away from the bottom upwardly, the bag cannot be "pinched-off" and a cut off in the flow of the product is avoided. This arrangement has a more expensive fabricating process.

The bag system has a number of variants. In one variant, a bag is inserted into the can and it is either brought out and around the lip of the can or it is sealed to the chime or top rim of the can. In either case, special folds or pleats formed in the bag or a collecting tube in the bag are necessary to prevent the bag from collapsing and pinching or cutting off the flow of the product, especially as the bag collapses toward the top of the can under pressure while the product is being expelled. The bag system tends to be expensive because the bags have to be made with either folds or pleats to avoid the "pinching-off" problem. A further disadvantage of a bag system is that bags which are connected at their opening to the lip or chime of the cans tend to both collapse and tear off at the chime or at the seams. Although inserting a collecting tube into the bag may overcome some of these problems, the increased cost tends to make this approach impractical. In a modification of the just described bag system, the bag is simply secured at the top or the bottom of the can, without being a specially designed bag, and this does not have a capacity of fully expelling all of the contents of the can.

In another variant of the bag system, the bag is fixedly secured part way along the height of the can, between the ends of the can. In typical examples of this system, the position of the bag along the height of the can is predetermined, before can assembly and filling, by the bag being secured between bottom and top halves of a two part container, by an attachment fixture in the can, or by slots or grooves in the can which fix the location of the bag. Such a bag may be capable of everting for expelling all of the contents of the can. But, this variant is not universally efficient for all pressures or all materials being expelled, for all types of propellants or all sizes of cans, and assembly of a can with such a bag system may be difficult or expensive.

Different propellants, e.g. a gaseous propellant or a liquid propellant, require that they occupy quite different percentages of the total volume of a can, as discussed in more detail below. For any particular size can, where the position of the bag along the can is predetermined by the can design, it is necessary for a manufacturer to design and inventory different sets of cans for differently positioned bags in the cans. A can which is more universally usable would be preferred.

Where a can is pressurized, this would tend to expand its side walls, that is, unless they were relatively thick and rigid and thus more expensive than thinner walled, lighter weight cans. Also, the barrier to can wall seal would end upon can wall expansion.

SUMMARY OF THE INVENTION

It is an object of the present invention to provide a barrier system for a pressurized can which may be used with many types and viscosities of fluent products, which is effective and which may be less expensive than other known barriers.

Another object of the invention is to enable the dispensing of the entire product contents of a pressurized can without product being trapped in the can by the barrier system.

It is a further object of the invention to provide a barrier system which may be used with a great variety of cans, including cans which are oddly shaped.

Yet another object of the invention is to provide a barrier which can be used with pressurized cans constructed of relatively thin, flexible side walls.

Another object of the invention is to provide an effective barrier in a can between the product to be dispensed and the pressurized dispensing propellant.

It is still a further object of the invention to provide a barrier system which can be firmly and immovably attached to the peripheral side wall of the can to avoid sealng problems.

Yet a further object of the invention is to provide a barrier system using a flexible diaphragm which can be easily disposed at any selected location along the height of the can.

Another object of the invention is to assure that the flexible diaphragm positioned in the can will remain sealed to the side wall of the can even as the pressure in the can causes its walls to expand.

The foregoing and other objects are realized by a barrier system for a pressurized can from which a fluent product is dispensed under pressure through a discharge valve in the can. The can has a peripheral side wall which surrounds a top opening through which the can may be filled with a product. The can side walls are thin enough that under pressures to which the contents of the can are pressurized, the side walls will flex and expand outwardly slightly.

A flexible diaphragm, perhaps in the shape of a cup, is mounted in the can to divide the can into a product chamber which comprises the volume above the diaphragm and a propellant chamber which comprises the volume below the diaphragm. The diaphragm is impervious to the product being dispensed and to the propellant for dispensing it. The flexible diaphragm is sealed to the peripheral wall of the can to guarantee that neither the propellant nor the product can leak past that seal, and the seal is maintained according to the invention even when the can pressure causes the can walls to flex and expand.

The securing means for the diaphragm comprise a fairly rigid ring of plastic, or the like, which is disposed inside the open peripheral edge of the diaphragm. The ring has a peripheral exterior shaped and sized for snugly fitting against the inner surface of the side wall of the can. The ring is inserted into the diaphragm, and the ring inside the diaphragm presses against the side wall of the can. The ring is placed in the can at a height which will allow the diaphragm to be everted as described below.

As the can walls are flexible and are expected to flex slightly when the can is pressurized, the ring must assure the continuing seal between the product and propellant chambers, respectively above and below the diaphragm. Appropriate means comprising at least one of either the can wall and the inserted ring are stressed and deformed before the can is pressurized such that upon pressurization of the can and slight expansion of its side wall, the seal is still maintained.

In one embodiment, the ring includes expansible wall engaging means at its periphery which are sized so that when the ring is installed in the can before the can wall has expanded, the expansible means on the ring are compressed and deformed by the contact with the wall of the can. For example, a plurality of resilient annular ridges or flanges may be defined on the ring periphery. The flanges normally have a fully extended diameter greater than the expanded diameter of the can wall. Upon pressurization of the can, with corresponding expansion of its flexible wall, the expansible means, i.e. the flanges on the ring, expand or flex outwardly to maintain contact and seal with the wall. In an alternate embodiment, the periphery of the ring includes a receptacle, such as a groove, for receiving an expansible means, such as a separate, expansible and compressible O-ring. The O-ring is of a diameter to be compressed when the sealing ring is inserted in the can. The O-ring is expansible to maintain a seal with the side wall of the can when the can expands.

In a second embodiment for accomplishing a similar result with a flexible can wall, the ring is rigid and its periphery is rigid. However, the ring diameter is selected to be slightly greater than the diameter of the can when the can is unpressurized. As the ring is installed by pushing it into the can, it deforms the side wall outwardly. Wherever the ring is lodged along the height of the can, the can will be slightly deformed outwardly at that location. The extent to which the ring diameter is greater than that of the can is only slight. Too great a difference in these diameters would permanently deform the can wall to a new shape, and upon pressurization, the seal between the can wall and the ring would be broken. However, slight deformation of the can wall would not cause a permanent change in shape of the can wall. When this can is pressurized, its wall above and below the ring expands, while the slightly deformed section of the can wall at the ring does not correspondingly expand, and the can to ring seal is thereby maintained.

In one embodiment, the flexible diaphragm is formed from a sheet with a surface area which is greater than the transverse cross-section of the can. The sheet may form the shape of a cup. The flexible diaphragm is extendible into the can below the ring when the can is filled with product, and is extendible above the ring through the pressure exerted by the propellant in the propellant chamber as product is being expelled from the product chamber. The flexible diaphragm is everted above the ring and pushes the product out until substantially all of the product has been expelled.

The can is fitted with an upper cover which also supports a discharge valve through which the product is eventually expelled. The can is filled with product up to the underside of the cover. The upper cover may be in the shape of a dome, and the product discharge valve can be fitted at the apex of the dome. A gaseous or liquified propellant is introduced into the bottom of the can beneath the diaphragm to define the propellant chamber and this serves to pressurize the product within the can above the diaphragm.

As the product is expelled through the discharge valve, the diaphragm under pressure from below begins to evert into the upper region of the can to continually keep the product pressurized. The size or surface area of the diaphragm and the point along the height of the can at which it is secured to the can are chosen such that when the diaphragm is fully everted, its top surface is in contact with the peripheral side wall and with the upper cover of the can to ensure that substantially all of the product has been expelled from the can.

The flexible diaphragm may alternatively even comprise a stretchable membrane which can be mounted by the ring and which will perform the previously described functions of the diaphragm. The product is still forced out through the discharge valve by the propellant which is present below the diaphragm. After a sufficient quantity of the product has been expelled, the pressure beneath it will stretch the diaphragm into the upper region of the can until all the product has been expelled.

Other features and advantages of the invention will be apparent from the following description of the preferred embodiments illustrated in the accompanying drawings.

BRIEF DESCRIPTION OF THE DRAWINGS

FIG. 6 shows a first sealing ring embodiment for the diaphragm for providing the seal between the product and propellant chambers of the pressurized can.

FIG. 7 shows a second embodiment of such a ring.

FIG. 8 shows a third embodiment of such a ring and can construction for such purpose.

FIG. 9 shows an alternate embodiment of pressurized can in which the rolling diaphragm comprises a stretchable resilient membrane.

DETAILED DESCRIPTION OF THE PREFERRED EMBODIMENTS

Figure 2:
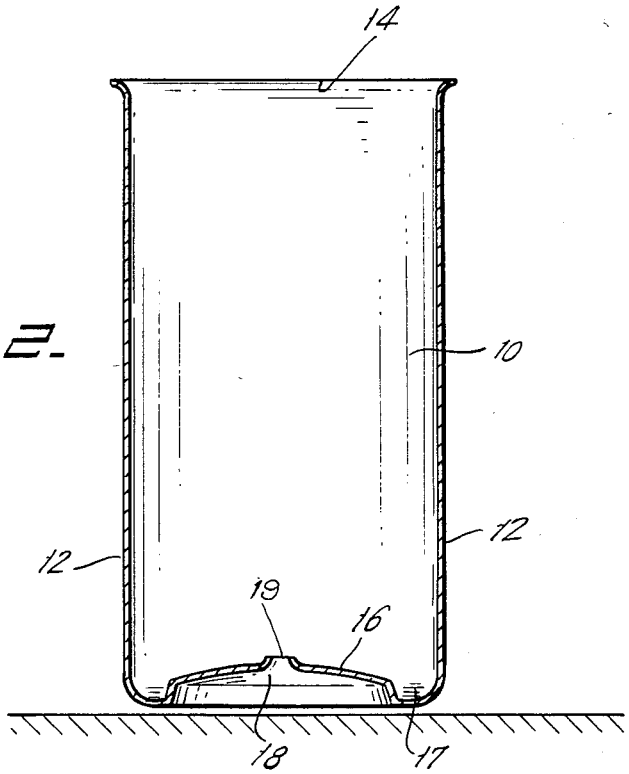
FIG. 2 shows the can body prior to the insertion of the diaphragm and ring.

Referring to FIG. 2, the pressurizable can according to the invention includes an outer can 10 comprising a cylindrical body, defined by a cylindrical peripheral side wall 12, an open top 14, and a closed bottom 16 shaped to allow the pressurized can to stably rest on a flat surface. For strength, the can bottom 16 includes a peripheral rounded ridge 17 on whose crest the can sits, and a rounded depression 18. The top of the depression has a pluggable hole 19 through it into the can. A gaseous or liquified propellant is conventionally supplied (from a source not shown) through the hole 19 after the top opening 14 has been closed so that the can may be pressurized. Thereafter, a plug 21 is installed in the hole 19 to close it.

The material of the can is typically metal. However, other materials like strengthened paper or plastic may be used, so long as it is strong enough to contain the pressure in a filled pressurized can. For economic reasons, that is to reduce the amount of materials required in can fabrication, it is desirable to have thin walled cans. For safety, it is desirable often that the can be of metal.

For example, at the lower pressures described below, the can may be of sheet steel or even sheet aluminum of the thickness of 0.005–0.008 inch. It is even possible to use a steel can with a wall thickness of 0.0045 inch. In such a can which is sealed and under pressure, and where the temperature to which the can, its contents and the propellant therein are exposed is in the range of 30°–130° F., the pressurization of the can could cause an increase in its diameter of between 0.002–0.007 inch for temperatures of 30°–130° F., respectively. In other words, for a can with a diameter of 2.50 inches, as discussed below, its diameter will increase by at least approximately one one-thousandth (1/1000) of its unexpanded length as it is pressurized to a pressure such as 100 psi. It has been found that even a gap of 0.001 inch between the side wall of the can and a ring supporting a diaphragm in the can will permit leakage of propellant and/or product past the ring and diaphragm, which is undesirable.

Because the propellant is not mixed with nor expelled with product from the can 10, the initial pressure and quantity of the propellant in the can need not be very high, and with some very fluent products and relatively larger discharge valve orifices, the can pressure can be quite low, e.g. 10–60 psig for low viscosity products, as compared with the conventional aerosol barrier can pressure of about 90–100 psig.

There are a variety of different propellants which may be placed in the pressure chamber, including various compressed gases or liquified gases. Where the propellant is a compressed gas, typically in an aerosol container, the compressed gas pressure chamber occupies in the range of $\frac{1}{3}$–$\frac{1}{4}$ of the total volume of the entire can. On the other hand, where the propellant is in the form of a liquified gas, the pressure chamber occupies in the range of 1/10–1/50 of the total volume of the can. It is economically desirable to produce a standard can design which can include a diaphragm that is adapted for either type of propellant, that is where the propellant chamber can be relatively smaller in volume or where it must be larger. The invention permits this.

Also, there is a wide variety of fluent products which may be contained in and expelled from the can 10, including quite fluent liquids of a viscosity of 10,000 cps or less and higher viscosity products like processed foods, e.g. cheese at a viscosity upwards of 300,000 cps or even higher, depending on the rheological properties of the product. Very low viscosity products, such as water and alcohol (vis. 1 cps or less) may also be contained and expelled.

Referring to FIGS. 1, 3–5, there is a rolling, flexible diaphragm 20 in the can, which is shown in the shape of a cup. Most broadly stated, the diaphragm is a sheet of greater cross-section than the can, and the diaphragm sheet is cut and folded so that the cup shape may be defined. Further, the sheet may have a pocket or generally tubular shape or it may be flat, so long as its surface area is great enough that the sheet will extend to the bottom or to the closed cover of the can, as described below. The cup shaped diaphragm has a side wall 22 and a closed bottom. The diaphragm may simply be a flat sheet which is deformed in use. It may be a sheet with cut regions which enable the sheet to be shaped into a cup, and the cut regions of the sheet are attached to the can at their margins. The cup is of a flexible material so that the cup may be filled and later everted as described below. The cup may also be made by vacuum forming or blow molding.

The material of the diaphragm 20 need merely be sufficiently flexible to deflect as described and be impervious to the product and to the propellant which contacts the diaphragm at its opposite sides. For example, an inexpensive plastic sheet material may be employed. The diaphragm may be of a paper, e.g. a waxed paper. It may be of any appropriate fabric. It could even be a metallic diaphragm.

Figure 1:
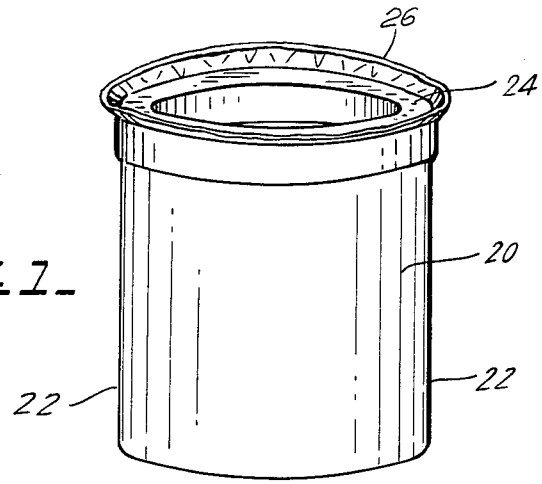
FIG. 1 shows a cup shaped diaphragm assembled with a sealing ring prior to insertion into the can body.
Figure 3:
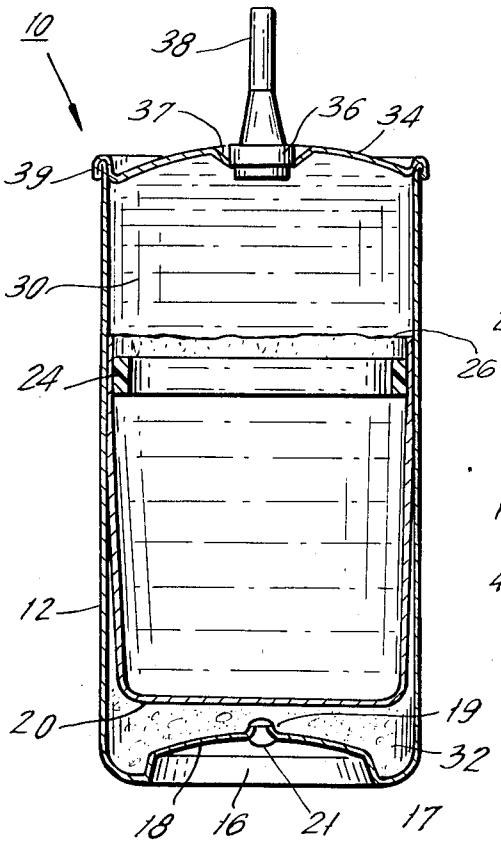
FIG. 3 is a cross-sectional, elevational view showing a pressurized fluent material containing and dispensing can having in it a rolling diaphragm according to a preferred embodiment of the invention.

Referring to FIGS. 1, 3 and 6, a diaphragm fastening ring 24 is inserted into the diaphragm 20 and is positioned in the region near the upper opening 26 of the cup shape. The rolling diaphragm 20 with its ring 24 are inserted into the can 10 and are positioned a distance down from the open top 14 of the can. The dimensions of the ring 24 and the diaphragm are selected such that the ring 24 can snugly fit against the peripheral side wall 12 of the can 10, thereby securing the rolling diaphragm cup 20 firmly in the can. In this manner, the can 10 is divided by the cup into the upper product chamber 30 and the bottom propellant chamber 32. The size, i.e. surface area of the diaphragm is coordinated with height of the can 10 and with the position of the ring 24 along the height of the can so that when the diaphragm is substantially fully extended, it will extend toward the bottom of the can and be fully in contact with the peripheral side of the can when the can is loaded with the product and it will extend toward the top of the can and be fully in contact with the side of the can and with the cover over the can when all the product has been expelled.

For use with liquified gas propellants, the initial volume of the upper product chamber 30 may be much larger than that of the bottom propellant chamber 32, on the order of 15 or 20 to one, thereby utilizing the majority of the space within the can body for the product. For use with compressed gas propellants, the initial volume of the product chamber 30 to the initial volume of the propellant chamber 32 would typically be on the order of 2 or 3 to 1. To accommodate these different volume chambers in a can of a standard size, and to enable the two chambers 30, 32 to have a correct volume relationship, it is desirable to be able to position the ring 24 and the diaphragm at appropriate selected positions along the height of the can wall.

As the invention is intended to assure complete expulsion of product in the chamber 30, the diaphragm size is selected so that the diaphragm will press against the inside of the can cover on eversion to expel product, and the diaphragm will not there be folded or wrinkled but will instead be fully extended. Because the pressure chamber 32 is typically of smaller volume than the product chamber, the ring 24 will typically be closer to the bottom than to the top of the can. Therefore, a diaphragm that is unwrinkled when it is fully everted may be wrinkled when the can is first loaded.

The two chambers 30, 32 are sealed off at the peripheral side wall of the can by the outward force exerted by the ring 24 on the wall 12. As the pressures in the product and propellant chambers are identical when the discharge valve 38 is closed and are nearly identical when that valve is open, the holding ring is not likely to move along the wall of the can.

After the product has been loaded in the product chamber 30 of the can 10 and the propellant has been loaded in the propellant chamber 32 of the can 10, the can is pressurized. The internal pressure in the can causes the side wall of the can to bulge slightly in diameter. For example, if the can 10 is of aluminum with a 2.5 inch diameter and with a wall that is 0.005 inch thick, when the can is pressurized at normal room temperature, its diameter will increase approximately 0.004 inch. If this expansion is not compensated for, a radial clearance will be created between the interior of the can wall and the exterior of the ring 24. The radial clearance will provide a leakage path between the product and propellant chambers allowing gas and/or product to bypass the diaphragm cup 20, resulting in a pressure reduction in the can, leakage of propellant out of the valve of the can and inability to properly expel all of the product from the product chamber.

A number of embodiments described herein compensate for the bulging enlargement of the diameter of the can.

The first alternative is to provide the ring 24 with a preloaded, radially expansible, elastic seal against the can wall, so that even when the can expands as it is pressurized, the ring expands with the can and maintains the seal. As shown in FIG. 6, the ring 24 is provided on its periphery 42 with a vertically spaced array of annularly uninterrupted, resilient flanges 44, each with a diameter greater than the anticipated inside diameter of the can when it has been expanded under pressure. The flanges 44 are thin and flexible enough that as the ring 24 is installed in the can, the flanges 44 are deflected radially inwardly, that is, they are somewhat flattened against the periphery 42 of the ring. As the can wall expands upon pressurization, the resilient, somewhat flattened flanges resiliently deflect slightly outwardly to maintain their biased contact against the internal wall of the can for pressing the diaphragm against the can wall and maintaining the seal.

In the second embodiment of FIG. 7, in contrast, the ring 46 is of a different design. It is a solid, annular body with an exterior peripheral channel 48 which opens radially outwardly. The channel receives and holds in it an elastic, resilient, compressible sealing element 50, illustrated as an O-ring. The diameter of the sealing element ring 50 is slightly greater than the internal diameter of the can, even when the can has stretched under pressure. When the ring 46 with the captive O-ring 50 in the channel 48 is installed in the can, the O-ring 50 is compressed through its engagement against the can wall. As the can wall expands under pressure, the resilient ring 50 tends to restore itself to its undeflected condition and is biased outwardly against the diaphragm and the can wall for maintaining the seal there.

The third embodiment shown in FIG. 8 uses a different approach to accomplish the same result. The above described thin, metal can wall is slightly deformable under pressure. If the can wall is only slightly deformed, at less than the degree of deformation which will permanently deflect the can wall from its normal profile, the normal resilience of the metal can material will tend to restore the wall to its original undeflected shape. (This is what occurs as the can is pressurized to a normal extent and is gradually depressurized through use.) As shown in FIG. 8, the annular ring 54 inside the can 10 has an outer periphery 56 with a diameter that is only slightly greater than the diameter of the can wall even when that wall is pressurized. As a result, when the ring 54 is installed in the can, it does not unduly stretch and deform the can wall. The can wall therefore does not assume a new, deformed shape. Instead, the can wall yields slightly as the ring is moved along the can wall until it is finally lodged in a selected position. The resilient, but not permanently deformed can wall maintains a tight seal with the ring and prevents leakage past the ring between the can chambers. The ring 54 is sized so that it stretches the can wall larger than the diameter to which the can would expand at maximum loaded pressure and maximum anticipated temperature. For example, if an aluminum can with a 2.50 inch inner diameter and with 0.005 inch thick wall is pressurized to 60 psi at 70° F., it expands approximately 0.004 inches in diameter, to an inner diameter of 2.504 inches. This will create a hoop stress of approximately 15,000 psi. The ring 54 has its periphery sized to expand the can wall to 2.509 inch diameter. That will create a hoop stress in the area of the ring of approximately 33,750 psi, which is still quite below the yield point of the aluminum can material and of the ring. Even if the internal pressure in the can is raised to 100 psi at 70° F., this will only expand the can to approximately 2.507 inch, with a hoop stress of 25,000 psi. Under all expected circumstances to which the can may be exposed, the can will, therefore, not expand so that its inner diameter is greater than the outer diameter of the periphery 56 of the ring. Good sealing contact will thereby be maintained and bypass of the ring between the two chambers is avoided.

The above techniques of maintaining a seal rely upon the elasticity of at least one of the can and ring for maintaining the seal, with the first mentioned techniques of FIGS. 6 and 7 using the resilience of the ring to maintain the seal and the latter technique of FIG. 8 using the resilience of the can to maintain the seal.

A completely assembled pressurized can is shown in FIG. 3. The upper cover 34 closes off the top opening 14 of the can. The cover 34 is shown dome shaped and has an apex 36 with a hole 37 through it in which a hole sealing, product discharge valve 38 is affixed. The cover is crimped to the chime 39 at the top of the can.

The can is filled with a fluent product through the hole 37 before the discharge valve 38 is emplaced. This moves the diaphragm 20 down to the bottom of the can and defines and completely fills the diaphragm 20 and the product chamber 30. The can is filled with product to the underside of the cover 34, i.e. until it is completely filled. Then the discharge valve 38 is emplaced, which closes the hole 37. The discharge valve may be a known tilt operated valve (or any other valve suitable for the purpose), and it seals the product chamber when it is closed. Next, the propellant chamber 32 is filled with a gaseous, or liquified propellant through the hole 19. When the desired pressure level or quantity is attained, the gaseous pressure supply or liquified propellant is removed and the hole 19 is plugged by a plug 21. The can is now ready for operation.

Figure 4:
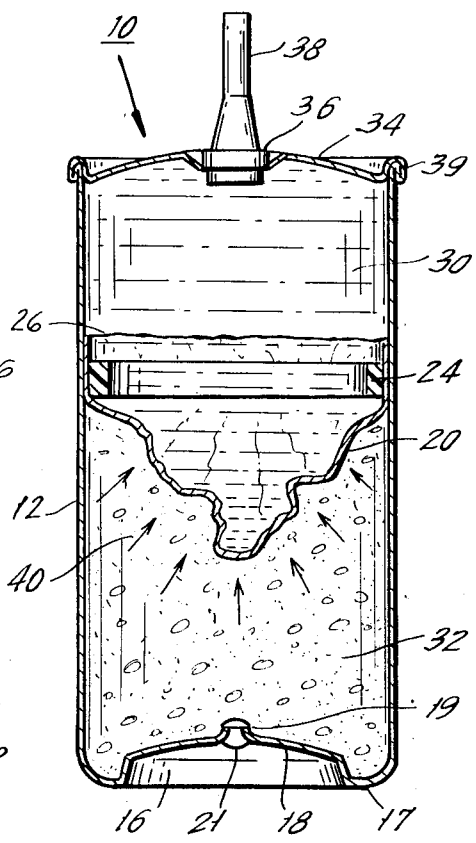
FIG. 4 shows the pressurized can after it has been filled with product and sealed with a top cover and after a small quantity of product has been expelled from the can.

The can in FIG. 4 is shown at a stage after a portion of the product has been expelled from the can through the valve 38. The rolling diaphragm 20 is shown partially everted due to the propellant as the diaphragm assumes a shape defined by the remaining product.

Figure 5:
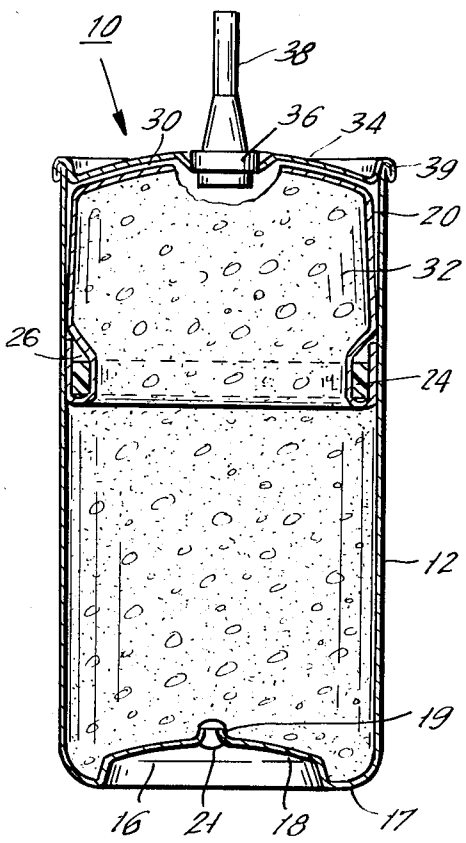
FIG. 5 shows the can and rolling diaphragm after all the product has been expelled.

Because the rolling diaphragm is fixed to the peripheral side wall 12 at a height which is near the middle of the can 10 with its cover on, the diaphragm moves from extending downward into the can, is deflected up past the ring 24 and finally everts and extends upward into the cover 34, as all the product is finally expelled, as shown in FIG. 5. This eversion prevents the diaphragm from pinching-off and restricting complete expulsion of the product due to capturing some product in a pinched-off region.

The rolling diaphragm cup, is so shaped and the ring 24 is so positioned that when the diaphragm 20 is fully everted as shown in FIG. 5, it fills the space bounded by the cover 34 and the side wall 12 of the can located above the fastening ring 24. When the product chamber 30 is filled before product is expelled, the diaphragm fills a portion of the space bounded by the container bottom 16 and the side wall of the can. This assures that almost the entire volume which is bounded by the walls and bottom of the can 10, besides that volume needed for propellant, may be filled with the product and that all of the product is usefully expelled from the can when the rolling diaphragm has been fully everted.

The sealing effectiveness can be increased through the introduction of sealing compounds between the fastening ring and the rolling diaphragm and/or between the diaphragm and the can wall.

As the pressure differential across the diaphragm is usually quite small, it may alternatively be sufficient to secure the rolling diaphragm cup 20 directly to the can wall without a ring 24 by instead employing a ring of adhesive directly between the entire upper end of the rolling diaphragm and the can wall. This arrangement still must compensate for the anticipated expansion and contraction of the can under pressure. The diaphragm, at least at its periphery, must be expansible and contractable with the change in diameter of the can. In addition, the adhesive used for holding the diaphragm to the can must be expansible and contractable sufficiently to compensate for the change in can diameter. The diaphragm and the adhesives must be capable of stretching as needed without tearing and without tearing away from the periphery of the can.

A modified embodiment of the rolling diaphragm appears in FIG. 9, which shows a resilient, elastic diaphragm 62 which may be attached to the peripheral side wall 12 of the can 10 in the manner previously described. Prior to the loading of the product chamber 30 of the can 10 with product, the diaphragm 62 extends generally flat across the can at the position marked with reference numeral 64. As the product is loaded into the can through the top, the diaphragm 62 stretches downwardly to assume the general shape shown at 66. After the top of the can is sealed at the discharge valve, propellant is introduced into the propellant chamber 32 of the can 10 below the fastening means 24 to pressurize the product in the product chamber 30 of the can. As the product is expelled from the can 10 through the discharge valve, the diaphragm 62 first returns to its original non-stretched flat position. As more product is expelled, the diaphragm begins to stretch upwardly under the propellant pressure until it finally assumes the shape shown at 70. At this position, all of the product has been expelled from the container.

The invention simplifies production of the can and its product-propellant barrier and eliminates concern about close manufacturing tolerances for the diaphragm and for its attachment to the can. For example, in previous barrier pack cans, which employ a piston barrier system, or in the bag barrier system with folded or pleated bag side walls needed to enable the bag to collapse, the consistent predictable shape of the can 10 was critical to the operation of the barrier system. With a piston system, an indentation in the container above the piston would prevent the piston from traveling up the peripheral side wall of the can. Similarly, in the case of a bag with folded sides, an indentation would tend to interfere with the traveling of the bag toward the discharge valve. With the present barrier system, however, the container can be of almost any size or shape. It is not even necessary that the peripheral side walls of the container be generally parallel to each other as with other known systems. Consequently, cans could be used with either esthetically pleasing shapes or other shapes which are designed in accordance with human factor engineering principles.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A pressurizable container for containing a fluent product under pressure and for dispensing the product through a discharge valve, said container comprising:

a can with a peripheral wall surrounding and defining a top opening of said can through which said can is filled with product; said peripheral wall being of a material which is resilient and slightly expands upon the can being pressurized and restores its unexpanded condition as the can pressure is reduced; said peripheral wall having a diameter which increases by at least approximately one one-thousandth (1/1000) of its length in the unexpanded condition as the pressure in the can goes from the unexpanded condition to a pressure of 100 psi;

a flexible diaphragm mounted in said can and dividing said can into a product chamber comprising the volume above said diaphragm for containing a fluent product to be stored and dispensed and a propellant chamber comprising the volume below said diaphragm for containing a propellant adapted to provide gas pressure upon said diaphragm to urge said diaphragm upwardly into said product chamber for expelling the product; said diaphragm being comprised of material that is impervious to the product and propellant in their respective said chambers;

a ring in said can for securing said diaphragm to said peripheral wall of said can and for defining a seal for preventing propellant and product from leaking past said ring and said diaphragm as said can expands under pressure; said ring cooperating with said can for also permitting said ring to be disposed at various locations along the height of said can without requiring that said ring be placed at a particular height along said can, at least one of said ring and said can being sufficiently resilient to deform resiliently upon installation of said ring in said can to create and maintain such seal and also to resiliently press said ring against said can wall to continue to maintain said seal as said can wall expands;

said flexible diaphragm being extendible into said can below said ring when said product chamber is initially filled with sufficient quantity of a fluent product and being gradually extensible above said ring through pressure generated by propellant in said propellant chamber to expel the fluent product out of said can past said top opening; said diaphragm is extended away from said ring when said diaphragm is extended into either of said product chamber and said propellant chamber.

2. A container according to claim 1, wherein said diaphragm has a surface area greater than the cross-section of said can.

3. A container according to claim 1, wherein said ring has a periphery facing toward said can peripheral wall; said ring having expansible-contractable means at said periphery thereof for engagement with said can peripheral wall, and said ring being of a size with respect to the diameter of said can that said expansible-contractible means are deflected and contracted upon installation of said ring and said diaphragm in said can while said can is unpressurized and said expansible-contractable means being adapted for expanding to maintain the seal between said periphery of said ring and said can peripheral wall upon said can being pressurized and the diameter thereof increasing slightly.

4. A container according to claim 3, wherein said expansible-contractable means comprises an annular, deflectable flange on said periphery of said ring.

5. A container according to claim 4, wherein there are a plurality of said flanges on said periphery of said ring arranged above each other along the height of said ring.

6. A container according to claim 3, wherein said expansible-contractable means comprise a compressible, resilient element supported at said periphery of said ring for expanding into continuous sealing engagement with said peripheral wall of said can.

7. A container according to claim 6, wherein said ring includes an annular groove at said periphery thereof and said compressible, resilient element comprises an additional ring around the first-mentioned said ring and supported in said groove in the first-mentioned said ring.

8. A container according to claim 1, wherein said ring has a diameter which is slightly greater than the diameter of said peripheral wall of said can when said ring is in said can and said can is not pressurized, for slightly deflecting said can peripheral wall without permanently deforming the same; said diameter of said ring with respect to said diameter of said peripheral wall of said can being selected such that when said can is pressurized and said can peripheral wall thereby increases in diameter, said ring diameter still remains greater than said diameter of said peripheral wall of said can, for thereby maintaining a seal between said ring and said peripheral wall of said can.

9. A container according to claim 2, wherein said flexible diaphragm has a cup shape, having an upper opening at which said cup is secured to said wall of said can and having a closed bottom away from said upper opening; said cup being deformable between an initial condition wherein said bottom of said cup extends down below said ring and a final condition wherein said cup is everted with said bottom of said cup extending up above said securing means and toward said top opening.

10. A container according to claim 9, further comprising an upper cover fitted over said top opening of said can for retaining product in said product chamber, and a discharge valve in said can for allowing product to be discharged therethrough.

11. A container according to claim 10, wherein said discharge valve is placed in said cover.

12. The container according to claim 10, wherein said ring is so located relative to said peripheral wall of said can and said cup is so shaped and sized that at least when said cup is fully everted to expel product and to substantially eliminate said product chamber, said cup is stretched out to avoid pinched-off pockets of product.

13. The container according to claim 1, wherein said flexible diaphragm comprises a stretchable membrane, said membrane being fixed to said peripheral wall of said can; said membrane being stretchable into said can below its affixation when a product is introduced into said product chamber and being stretchable above its affixation by propellant in said product chamber when a sufficient quantity of the product has been expelled from said can.

14. A container according to claim 1, wherein said flexible diaphragm comprises a cup-shaped element having an open peripheral edge for mounting to the peripheral wall of the can, the ring being positioned within the open peripheral edge of the cup-shaped element for securing the cup-shaped element to the peripheral wall.

15. A container according to claim 14, wherein said cup-shaped element comprises plastic sheet material.

* * * * *